US007533982B2

(12) United States Patent
Yoneyama

(10) Patent No.: US 7,533,982 B2
(45) Date of Patent: May 19, 2009

(54) IMAGE RECORDING APPARATUS

(75) Inventor: Tsutomu Yoneyama, Kunitachi (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 284 days.

(21) Appl. No.: 10/925,069

(22) Filed: Aug. 24, 2004

(65) Prior Publication Data

US 2005/0046684 A1 Mar. 3, 2005

(30) Foreign Application Priority Data

Sep. 2, 2003 (JP) ..... 2003-309893

(51) Int. Cl.
*B41J 2/01* (2006.01)
*B41J 2/15* (2006.01)

(52) U.S. Cl. ..... 347/102; 347/21

(58) Field of Classification Search ..... 347/102, 347/21, 101, 20, 9, 15
See application file for complete search history.

(56) References Cited

U.S. PATENT DOCUMENTS 4,801,953 A * 1/1989 Quate ..... 347/46
6,164,757 A * 12/2000 Wen et al. ..... 347/43
6,296,342 B1 * 10/2001 Oikawa ..... 347/21
6,398,358 B1 * 6/2002 Miyake et al. ..... 347/102
6,464,336 B1 * 10/2002 Sharma ..... 347/43
6,805,439 B2 * 10/2004 Maeda et al. ..... 347/96
6,877,850 B2 * 4/2005 Ishimoto et al. ..... 347/100
7,044,593 B2 * 5/2006 Onishi ..... 347/101
7,196,821 B2 * 3/2007 Kakutani ..... 358/3.03
2001/0020964 A1 * 9/2001 Irihara et al. ..... 347/43
2002/0140794 A1 * 10/2002 Asano et al. ..... 347/102
2003/0035037 A1 * 2/2003 Mills et al. ..... 347/102
2003/0142168 A1 * 7/2003 Suzuki et al. ..... 347/43
2003/0164870 A1 * 9/2003 Yamamoto ..... 347/102
2003/0234848 A1 * 12/2003 Ishikawa ..... 347/102
2006/0284929 A1 * 12/2006 Matsuzawa et al. ..... 347/43

FOREIGN PATENT DOCUMENTS

JP 2002098589 A * 4/2002
WO WO 2004069543 A1 * 8/2004

* cited by examiner

*Primary Examiner*—Stephen D Meier
*Assistant Examiner*—Leonard S Liang

(57) ABSTRACT

An image recording apparatus which performs color image recording, including:

a color ink recording head which jets photo-curable color ink droplets onto a recording medium;

a transparent ink recording head which jets photo-curable transparent ink droplets onto a recording medium; and a light radiating device for radiating light rays onto the color ink droplets and transparent ink droplets, on the recording medium;

a control section for judging the amount of color ink droplets to be jetted, and for controlling the amount of transparent ink droplets to be jetted, based on the determined amount.

5 Claims, 3 Drawing Sheets

IMAGE RECORDING APPARATUS

BACKGROUND OF THE INVENTION

The present invention relates to an image recording apparatus, and more particularly, to an image recording apparatus which records image via an ink-jet method.

The image recording apparatus employing the ink-jet method (hereinafter referred to as an ink-jet image recording apparatus) has been known in the prior art as an image recording apparatus which works for a large item small volume production, according to circumstances. The ink-jet image recording apparatus jets ink droplets through nozzles, provided on the surface of a recording head, which faces a recording medium, after which the deposited ink droplets are fixed on the recording medium to record the image. Since the ink-jet image recording apparatus does not use a plate making process, differing from conventional image recording means which prints the image via a gravure printing method or a flexographic printing method, a characteristic of ink-jet image recording apparatus is that they quickly serve for a small volume production with ease. Further, the ink-jet image recording apparatus easily records color images using various colored inks at low noise, which is an advantage.

In recent years, an ink-jet recording apparatus employing photo-curable ink has become well known as the image recording apparatus which is able to print the image on various types of the recording media. Using the photo-curable ink which includes an initiator having predetermined sensitivity to ultraviolet rays, the ink-jet recording apparatus radiates the ultraviolet rays onto the photo-curable ink deposited on the recording medium, and thereby the photo-curable ink is hardened and fixed on the recording medium. In the ink-jet image recording apparatus employing the photo-curable ink, after the ink droplets are deposited on the recording medium, the ink droplets are hardened at once by the ultraviolet radiation. That is, since the ink-droplets scarcely penetrate through or bleed on the recording medium, the image can be recorded onto not only a normal sheet but also recording medium such as a plastic or metallic material which does not include an image receiving layer, and does not absorb the ink.

When the image is recorded on the recording medium having the image recording layer, most of the ink is absorbed by the recording medium, however, when the image is recorded on a recording medium not having the image recording layer, the deposited ink droplets are hardened and fixed as soon as the light rays are radiated, that is, the deposited ink droplets are not absorbed by the recording medium so that they remain on the surface of the recording medium to be hardened, forming a raised surface.

When the amount of deposited ink droplets is relatively large, bleeding results between adjacent droplets before curing, and thereby a raised surface of a smooth hard coating having lustrous reflection is generated on the surface of the recording medium. On the other hand, when the amount of deposited ink droplets is relatively small, a hard coating having an irregular surface with no reflecting surface is generated on the surface of the recording medium, resulting in no lustrous reflection. Such reflection caused by the amount of the deposited ink droplets is significantly apparent, when ink including a large amount of pigment is used.

When there is a hard coating featuring different smoothness on the surface of the recording medium, that is, on the image, the image is visually observed as an uneven reflective surface, which causes image deterioration over the total image, resulting in not precise image recording, which is a problem.

Concerning the technology for solving the uneven reflective surface generated on the recording medium, the technology is well known wherein the surface is laminated after image recording (See Patent Documents 1 and 2).

Patent Document 1: Japanese Tokkouhei 2-14912

Patent Document 2: Japanese Tokkaihei 9-70960

As described above, the merit of the image recording apparatus which records the image by an ink-jet method using photo-curable ink is that the image can be recorded on various types of recording media. However, if laminated finishing is conducted after the image is recorded, it is necessary that a special recording medium having a thermoplastic resin layer is used, therefore, the merit of ink-jet image recording apparatus, which can record the image on various types of recording media, is reduced, which is a problem.

Additionally, in order to conduct laminated finishing after image recording, a laminate finishing device must be incorporated in the image recording apparatus, which results in a complicated and larger sized apparatus, as well as a rise in the cost of the apparatus. Further, in order to conduct laminated finishing after-image recording, laminate finishing is conducted on the total surface of the recording medium, but as described above, when the image is recorded via photo-curable ink, an ink surface is raised and the reflection is generated on only the surface on which a relatively large amount of ink droplets are deposited, therefore there is no need to conduct laminating. Accordingly, if lamination is conducted on the total surface, a material for lamination utilized on the surface on which lamination is not necessary, results in waste of material and raised cost.

SUMMARY OF THE INVENTION

The present invention was achieved to solve the above problems. The objective of the present invention is to provide an image recording apparatus which is able to record an image with detailed and even reflection. The objective of the present invention can be attained by the structures described below.

Structure 1

An image recording apparatus which performs color image recording while conveying a recording medium in a predetermined direction, including:

a plurality of color ink recording heads which jet photo-curable color ink droplets, which are to be cured by radiated ultraviolet rays, onto a recording medium;

a light radiating device for radiating light rays onto the photo-curable color ink droplets deposited on the recording medium;

a transparent ink recording head which jets photo-curable transparent ink droplets, which are to be cured by radiated ultraviolet rays, onto a recording medium; and a control section for determining the amount of photo-curable color ink droplets to be jetted from the color ink recording heads, and for controlling the amount of transparent photo-curable ink droplets, to be jetted from the transparent ink recording head, based on the determined amount of photo-curable color ink droplets.

According to structure 1, the control section determines the amount of photo-curable color ink droplets to be jetted from the color ink recording head, and controls the transparent ink recording head to jet the photo-curable transparent ink droplets based on the determined amount of photo-curable color ink droplets, and thereby the total amount of inks (photo-curable color inks and photo-curable transparent ink) on the recording medium is uniformed.

Structure 2

The image recording apparatus described in structure 1, wherein the control section determines the amount of photo-curable color ink droplets to be jetted from the color ink recording head, with respect to a single pixel, being a single picture element, of the image data.

According to structure 2, the control section determines the amount of ink droplets to be jetted from the color ink recording head with respect to a single pixel of the image data, and thereby the amount of photo-curable transparent ink droplets to be jetted from the transparent ink recording head is controlled.

Structure 3

The image recording apparatus described in structure 1 or 2, wherein the control section controls the amount of photo-curable transparent ink droplets to be jetted from the transparent ink recording head, based on the amount of photo-curable color ink droplets to be jetted from the color ink recording head, as well as on the density of each color ink to be jetted from the color ink recording head.

According to structure 3, the control section controls the amount of the transparent ink droplets to be jetted from the transparent ink recording head, based on the amount of the color ink droplets to be jetted from the color ink recording head, as well as on the density of each color ink to be jetted from the color ink recording head, and thereby the reflective surface of the image is uniformed.

Structure 4

The image recording apparatus described in any one of structures 1 to 3, wherein the control section controls the amount of transparent ink droplets to be jetted from the transparent ink recording head, based on the type of the recording medium.

According to structure 4, the control section controls the amount of transparent ink droplets to be jetted from the transparent ink recording head, based on an ink absorbing capacity of the recording medium.

Structure 5

The image recording apparatus described in any one of structures 1 to 4, wherein the control section controls in such a manner that the amount of a single transparent ink droplet to be jetted from the transparent ink recording head is greater than the amount of the color ink droplet to be jetted from the color ink recording head.

According to structure 5, even when the number of the transparent ink droplets to be jetted from the transparent ink recording head is less than the number of the color ink droplets to be jetted from the color ink recording head, the control section functions to make the amount of the transparent ink droplets to be jetted from the transparent ink recording head to be equal to the amount of the color ink droplets to be jetted from the color ink recording head.

Structure 6

The image recording apparatus described in any one of structures 1 to 5, wherein the above described ink is an ultraviolet ray curable ink which is hardened by the ultraviolet ray radiation.

According to structure 6, when image recording is performed by using the ink which is hardened by radiated ultraviolet rays, the amounts of ink deposited on the recording medium can be uniformed.

The effects of the above structures will be described as below.

According to structure 1, the control section determines the amount of ink droplets to be jetted from the color ink recording head, and jets the transparent ink from the transparent ink recording head based on the determined amount, and thereby the amount of ink on the recording medium is equalized, and uneven surfaces can be prevented on the recording medium. Therefore, an image with detailed and even reflection can be effectively recorded, without any special treatment, such as lamination.

According to structure 2, since the control section determines the amount of color ink droplets deposited on the recording medium, with respect to each pixel, precise control can be performed so that the appropriate amount of transparent ink is effectively jetted.

According to structure 3, the amount of transparent ink droplets to be jetted from the recording head of the transparent ink can be precisely controlled in accordance with the amount of the color ink droplets, as well as the density of the color ink droplets. Generally, high density ink is characteristically more reflective than low density ink, even when the amount of both inks is equal. For example, magenta ink of general density is more reflective than low density magenta ink. Therefore, the amount of the transparent ink for the pixel printed by the low density magenta ink is less than that of magenta ink of the general density. By controlling the amount of transparent ink droplets based on the color ink amount and density, detailed images without the uneven reflection, can be effectively recorded.

According to structure 4, since the jetting amount of the transparent ink is adjusted based on the type of recording media, it is effectively possible to print images on various types of the recording media, and to always record precise images with an even reflecting surface.

When ink is hardened just after depositing, there is a delay for hardening. Several kinds of recording media absorb ink at a high speed, and there are cases when ultraviolet rays are radiated, almost all ink have been absorbed into the recording medium, resulting in a very slightly raised medium surface after hardening. In such a case, the difference of reflection on the total image is relatively small, and thereby it is necessary that the jetting amount of transparent ink is reduced. Further, depending upon the difference of reflection of the recording medium itself, the difference of reflection is changed after the image formation. That is, when the recording medium has a highly reflective surface, after large amounts of ink are deposited, an increase of reflection is hardly noticed. Therefore, it is preferable that the ejected amount of transparent ink is reduced.

As described above, reflection is differently generated, based on the type of the recording media, and therefore, the jetting amount of transparent ink is controlled based on the type of recording media so that printed images having uniform reflection can be effectively and efficiently produced.

According to structure 5, even when the number of the transparent ink droplets to be jetted from the recording head of the transparent ink is less than the number of color ink droplets to be jetted from the recording head of the color ink, the amount of transparent ink droplets can be controlled to be nearly equal to the amount of color ink droplets. Due to this, the amount of ink on the recording medium can be effectively uniformed, resulting in image recording with uniform reflection.

According to structure 6, since image recording is performed by using an ink which is hardened by radiated ultraviolet rays, high quality printing can be efficiently performed, independently of the type of recording media. Further when image recording is performed using ultraviolet-curable ink, ink deposited on the recording medium is hardened, and rises due to the radiated ultraviolet rays. In such cases, according to structure 5, the total amount of inks on the recording medium is uniformly controlled, and thereby uniform reflection of the surface of the recording medium is controlled, resulting in precise and uniformly reflective image recording.

DETAILED DESCRIPTION OF THE PREFERRED EMBODIMENT

Figure 1:
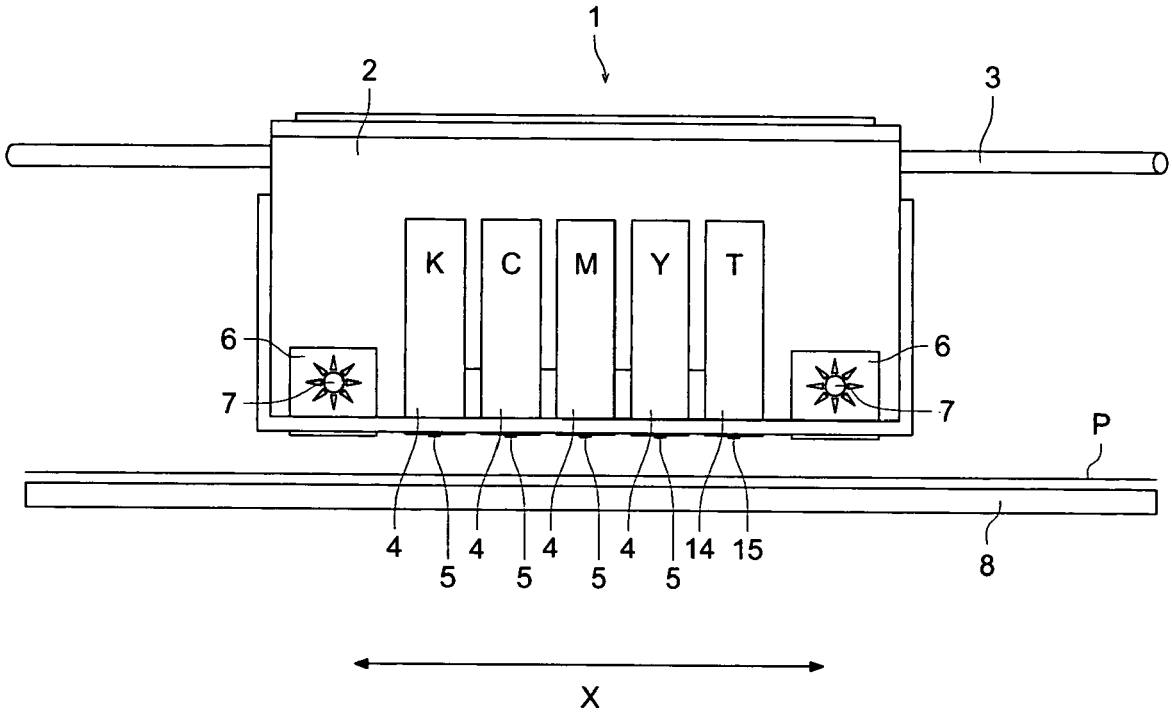
FIG. 1 is a schematic front view of an embodiment of an image recording apparatus relating to the present invention.

The preferred embodiment of the image recording apparatus of the present invention will be now described, referring to the drawings.

In FIG. 1, in the present embodiment, image recording apparatus 1 is a serial print method image recording apparatus, wherein platen 8 is provided to support the non-recording surface of flat recording medium P.

Further, image recording apparatus 1 incorporates conveyance rollers which are not illustrated, said conveyance rollers are rotated by conveyance mechanism 13 (see FIG. 2) so that recording medium P is conveyed in the orthogonal direction to the arrowed X direction in FIG. 1 (hereinafter referred to as main scanning direction X).

Above platen 8, cylindrical carriage rail 3 is arranged in direction to main scanning direction X. Carriage 2 is supported by carriage rail 3, and can reciprocally move in the main scanning direction X along carriage rail 3, powered by carriage driving mechanism 12 (see FIG. 2).

A group of four color recording heads 4, being yellow (Y), magenta (M), cyan (C) and black (K), used in image recording apparatus 1 of the present embodiment, are incorporated in carriage 2. Color ink used in image recording apparatus 1 is not limited to the above described color, and color inks such as light yellow (LY), light magenta (LM) and light cyan (LC) can also be used. In such a case, recording heads corresponding to the above color inks are also incorporated in carriage 2. A plurality of nozzles 5 for jetting ink are aligned in the longitudinal direction of color recording heads 4, on the bottom surface of each color recording head, facing recording medium P. Nozzles 5 can jet a plurality of ink droplets during each scan, and thereby the desired gradation can be displayed for each pixel.

Further, recording head 14 for jetting transparent ink T is incorporated adjacent to one of the outermost color recording head 4 (being Y in FIG. 1), on carriage 2. A plurality of nozzles 15 for jetting the transparent ink are arranged in the longitudinal direction of transparent ink recording head 14, on the bottom surface of transparent ink recording head 14, facing recording medium P.

Ultraviolet radiating devices 6 are respectively arranged between the side walls of carriage 2 and the outermost recording heads. Ultraviolet radiating devices 6 feature ultraviolet radiating sources 7 for radiating the ultraviolet rays onto ink which has been jetted and deposited onto recording medium P, and which serves to harden and fix the ink. Regarding ultraviolet radiating sources 7, a high-pressure mercury arc lamp, a metal halide lamp, a hot cathode lamp and LEDs are acceptable for use.

An ink used in the present embodiment is photo-curable ink which has nature to be hardened by radiation of ultraviolet rays, and includes at least polymerizable compounds (including well known polymerizable compounds), a light initiator and a coloring material, in major proportions. The above-mentioned photo-curable ink is classified broadly into radical polymeric system ink including radical polymeric compounds as polymeric compounds, and cationic polymerization system ink including cationic polymerization compounds. The inks of both systems are applicable for the present embodiment. Further, hybrid type inks in which the radical polymeric system ink and cationic polymerization system ink are combined are also applicable in the present embodiment. However, since cationic polymerization system ink hardly or not at all inhibit the polymeric reaction due to oxygen, cationic polymerization system inks are more functional and versatile, and therefore it is preferable to use cationic polymerization system inks. Cationic polymerization system inks are a mixture including at least cationic polymerization compounds, such as oxetane compounds, epoxy compounds, and vinyl ether compounds, a photo-cationic initiator, and the coloring material.

Further, regarding recording medium P, various papers, such as normal paper, recycled paper and glossy paper, various fabrics, various non-woven fabrics, resin, metal and glass are applicable. Regarding the format of recording medium P, rolls, cut sheet and plates are applicable.

Figure 2:
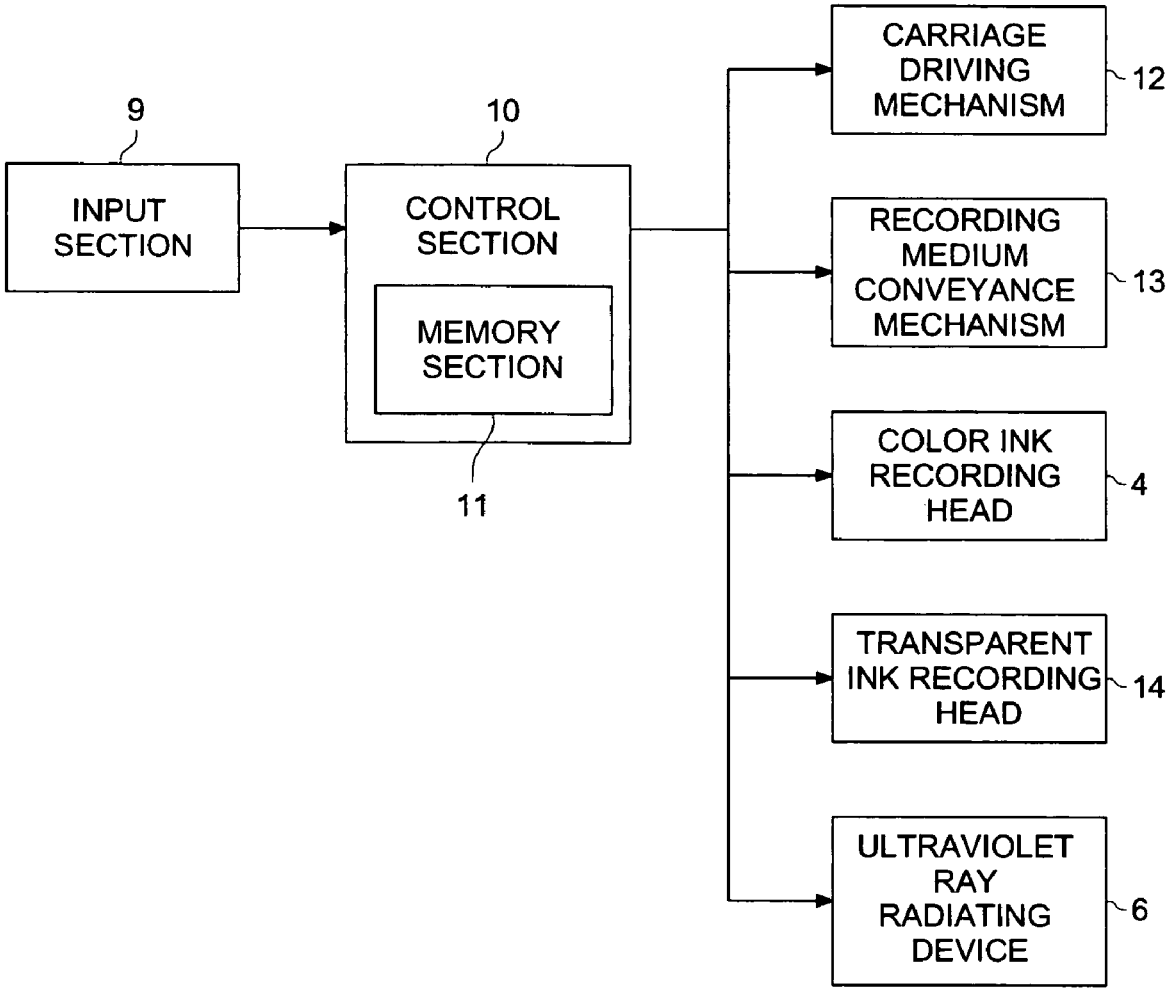
FIG. 2 is a block diagram of an embodiment of an image recording apparatus relating to the present invention.

Next, the control structure of image recording apparatus 1 of the present embodiment will be explained, referring to FIG. 2.

Image recording apparatus 1 is provided with input section 9 in which a user inputs the type of recording medium P and image recording conditions, after which information inputted into input section 9 is sent to control section 10. Input section 9 can be a keyboard or an operation panel, which is used for selecting the type of recording medium P which is used for recording the image, or selecting one of the various recording modes.

Control section 10 controls carriage driving mechanism 12 to reciprocally move in main scanning direction X, and also controls the movement of conveyance mechanism 13 for recording medium P in the conveyance direction, synchronizing it with the movement of carriage 2.

Additionally, control section 10 drives recording heads 4 for color ink and recording head 14 for transparent ink, based on image data inputted from input section 9, and thereby each ink is jetted so that the predetermined image is formed.

Before recording an image, the image data for each pixel unit are sent to control section 10 from input section 9, after which control section 10 determines the density level of the image to be recorded, using the image data. In this case, the density level of the image means the amount of ink in droplet form to be jetted for each pixel. On areas on which large amounts of color ink droplets are jetted from a plurality of color recording heads 4, ink droplets tend to overlap each other, resulting in high density, while on areas on which small amounts of color ink droplets are jetted, low density results. On high density areas, ink droplets are overlapped and the surface rises, resulting in much reflection, while on the other hand, insufficient reflection occurs on low density areas.

Further, image reflecting surfaces change based on the density of ink. Generally, high density ink exhibits higher reflection than low density ink, though both inks have the same amount of droplets. For example, lower density magenta ink has less reflection than normal density magenta ink. In this case, it is preferable that a smaller amount of the transparent ink is supplied per pixel for which lower density magenta ink is used, compared to pixels for which normal density magenta ink is used.

Control section 10 determines the density level of the image and adjusts the number of the droplets to be jetted for a single pixel from each of nozzles 5 of color recording heads 4. Next, control section 10 adjusts the ink amount to be jetted from each of nozzles 15 of transparent ink recording head 14, based on the color ink droplet amount and the color ink density.

Still further, control section 10 is provided with memory section 11, which incorporates a control program. The control program controls the droplet amount of the transparent ink corresponding to the droplet amount of the color ink, jetted for a single pixel. When control section 10 receives the image data with respect to a single pixel unit from input section 9, control section 10 reads out the necessary program from memory section 11, and determines the amount of ink to be jetted from transparent ink recording head 14, next controls transparent ink recording head 14 to jet an adequate amount of ink.

Figure 3:
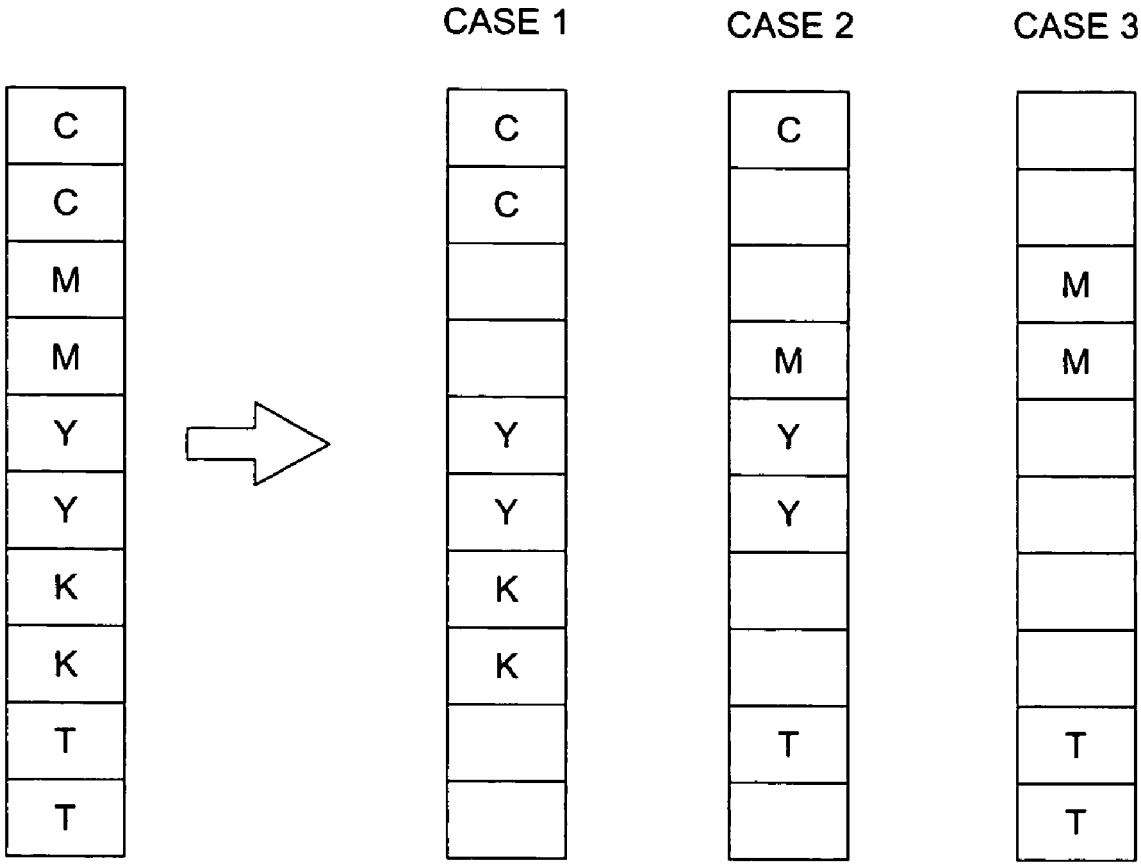
FIG. 3 shows the relationship between ink jetted from recording heads of colored inks, and ink jetted from the transparent ink recording head in an embodiment of an image recording apparatus relating to the present invention.

For example, in FIG. 3, assuming that color ink recording heads 4 are controlled so that they jet two droplets of color ink for a single pixel from color recording heads 4 corresponding to four inks (which are Y, M, C and K), there are three assumed cases as described below.

Case 1

The transparent ink is not jetted, when 6-8 droplets of color ink are jetted for a single pixel, Case 2

A single droplet of the transparent ink is jetted, when 3-5 droplets of color ink are jetted for a single pixel, and Case 3

Two droplets of the transparent ink are jetted, when 0-2 droplets of color ink are jetted for a single pixel.

In this case, in order to evenly uniform the amount of ink on the surface of recording medium P, it is necessary that the amount of the transparent ink droplets is nearly equal to the amount of the color ink droplets. When the maximum amount of the color ink droplets to be jetted from color ink recording heads 4 is eight for a single pixel, as shown in FIG. 3, it is preferable that the maximum amount of the transparent ink droplets to be jetted from transparent ink recording head 14 is also eight for a single pixel. However, it is not necessary to make the number of the transparent ink droplets to be equal to that of the color ink droplets, that is, by making the amount of a single droplet of the transparent ink to be greater than the amount of a single droplet of the color ink, it is possible to make the amount of the color ink to be nearly equal to the amount of the transparent ink. In this case, if the amount of a single droplet of the transparent ink is equal to the amount of two droplets of the color ink, the maximum number of the transparent ink droplets to be jetted from transparent ink recording head 14 is equal to or greater than one half the maximum number of color ink droplets to be jetted from color ink recording heads 4.

Memory section 11 features a control program which controls the amount of the transparent ink droplets, depending upon each type of recording medium P. If the material of recording medium P is one which does not absorb the ink, such as a film material, reflection of the surface of recording medium P largely depends upon the amount of the droplets jetted onto the recording medium P, and thereby, the amount of transparent ink droplets which is nearly the same as the amount of the color ink droplets must be jetted onto an area having a small amount of deposited color ink droplets. On the other hand, if the material of recording medium P is one which readily absorbs ink, such as normal paper, reflection of the surface of recording medium P depends hardly at all upon the amount of droplets jetted onto recording medium P, and thereby the amount of transparent ink droplets jetted onto recording medium P is relatively small, compared to the case of the image recording onto film material.

Control section 10 controls ultraviolet rays radiating devices 6 to radiate ultraviolet rays from ultraviolet ray sources 7.

Next, functions of the present embodiment will be described.

When control section 10 receives signals to start image recording, based on the type of recording medium P, and image recording conditions from input section 9, control section 10 sends signals to color recording heads 4, transparent ink recording head 14, and ultraviolet rays radiating devices 6, to begin preparation of image recording operation. Further, at the same time of the above preparation, by using the image data sent from input section 9, control section 10 determines the desired density level of the image depending upon the amount of color ink droplets and the ink density, jetted for a single pixel. Additionally, control section 10 reads out a control program from memory section 11, being a control program for the amount of the transparent ink to be jetted, based on the density level of the image determined by the image data, and on the type of selected recording medium P for image recording.

Control section 10 controls conveyance mechanism 13 of recording medium P to convey a predetermined amount of recording medium P in the conveyance direction, and activates color recording heads 4 and transparent ink recording head 14 based on the control program, and thereby, inks are jetted onto recording medium P from nozzles 5 of predetermined color recording heads 4, and from nozzles 15 of predetermined transparent ink recording head 14.

Next, the ultraviolet rays from ultraviolet ray sources 7 are radiated onto the deposited ink droplets on recording medium P, and thereby the ink droplets are hardened and fixed, resulting in a formed image on recording medium P.

In the present embodiment, a single transparent ink recording head 14 is placed adjacent to one side of the group of color recording heads 4, however, the number of transparent ink recording head 14 is not limited to one, and transparent ink recording heads 14 can be placed adjacent to both sides of the group of color recording heads 14.

Further in the present embodiment, in order to display the image gradation by a plurality of ink droplets for a single pixel, the driving frequency of the nozzle is set to be relatively high so that a plurality of the ink droplets are jetted during a single scanning. However, it is also possible to use a manner in which a single droplet is jetted during the first ink scanning, and one more droplet is jetted onto the same place during a second scanning, and thereby a plurality of the ink droplets can be jetted for a single pixel. Still further, by arranging the nozzles in two lines on the recording head, a plurality of the ink droplets can be jetted for a single pixel. Additionally, in this embodiment, gradation is obtained by jetting a plurality of ink droplets for a single pixel, but it is also possible to control the recording head to jet a single droplet for a single pixel.

Still further, in the present embodiment, used is a photocurable ink which is hardened by the radiation of ultraviolet rays, but ink is not limited to this type, and ink which is hardened by the radiation of light rays other than ultraviolet rays, can also be used. "Light rays" in this description means light rays in the broad sense of the term, which are electromagnetic waves, such as the ultraviolet rays, electron beams, X-rays, visual rays, and infra red rays. That is, such ink can be applied that includes the polymerizable compounds which is compounded and hardened by the radiation of such light rays other than the ultraviolet rays, and the light ray initiator which starts the polymerization reaction of the polymerizable compounds by the radiation of the light rays other than ultraviolet rays.

When photo-curable ink is used which is hardened by the radiation of light rays other than ultraviolet rays, a light source for those kinds of light rays is applied, instead of ultraviolet ray sources 7.

Still further, described in the present embodiment, is image recording apparatus 1, being a serial print method image recording apparatus, wherein while color recording heads 4 and transparent ink recording head 14 placed on carriage 2 are reciprocally driven in main scanning direction X, and while recording medium P is conveyed in the conveyance direction, the ink droplets are jetted from color recording heads 4 and transparent ink recording head 14, and thereby the image is printed. However, it is also possible to use an image recording apparatus employing a line head method, wherein while ink droplets are jetted from the color recording heads as well as from the transparent ink recording head, both of which are incorporated in a printer, recording medium P is conveyed, and thereby the image is printed.

According to the present embodiment, the amount of the color ink to be jetted is determined based on the difference of density level of the image for a single pixel, read out from the image data, and the transparent ink droplets are jetted onto the area having relatively small amounts of color ink droplets, and thereby, the amount of ink for the total image are fairly uniformed. Accordingly, without a laminating process after image recording, an image having a reflective surface and no irregular surface can be obtained.

What is claimed is:

1. An image recording apparatus which performs color image recording while conveying a recording medium in a predetermined direction, comprising:

a plurality of color ink recording heads which jet photo-curable color ink droplets onto a recording medium;

a transparent ink recording head which jets photo-curable transparent ink droplets onto a recording medium;

a light radiating device for radiating light rays, to harden the photo-curable color ink droplets and the photo-curable transparent ink droplets, deposited onto the recording medium; and a control section for determining an amount of photo-curable color ink droplets to be jetted from the color ink recording head, with respect to each pixel of image data, and for controlling an amount of photo-curable transparent ink droplets to be jetted from the transparent ink recording head, based on the determined amount of photo-curable color ink droplets to provide a uniform total amount of ink jetted onto the surface of the recording medium, wherein the control section controls in such a manner that the amount of a single transparent ink droplet to be jetted from the transparent ink recording head is always greater than the amount of a single color ink droplet to be jetted from the color ink recording head.

2. The image recording apparatus in claim 1, wherein the control section controls the amount of photo-curable transparent ink droplets to be jetted from the transparent ink recording head, based on a density of each color ink to be jetted from the color ink recording heads.

3. The image recording apparatus in claim 1, wherein the control section controls the amount of photo-curable transparent ink droplets to be jetted from the transparent ink recording head, based on a type of recording medium.

4. The image recording apparatus in claim 1, wherein the photo-curable color ink and the photo-curable transparent ink are ultraviolet ray curable type inks which are hardened by the radiation of ultraviolet rays.

5. The image recording apparatus in claim 1, wherein the control section determines the density of each color ink to be jetted from the color ink recording heads.

* * * * *